US007599649B2

(12) United States Patent
Miyoshi

(10) Patent No.: US 7,599,649 B2
(45) Date of Patent: Oct. 6, 2009

(54) DEVELOPMENT DEVICE AND PROCESS CARTRIDGE INCLUDING DEVELOPMENT DEVICE

(75) Inventor: Yasuo Miyoshi, Yokohama (JP)

(73) Assignee: Ricoh Co., Ltd, Tokyo (JP)

( * ) Notice: Subject to any disclaimer, the term of this patent is extended or adjusted under 35 U.S.C. 154(b) by 208 days.

(21) Appl. No.: 11/843,168

(22) Filed: Aug. 22, 2007

(65) Prior Publication Data

US 2008/0050137 A1 Feb. 28, 2008

(30) Foreign Application Priority Data

Aug. 22, 2006 (JP) ..... 2006-225724

(51) Int. Cl.
*G03G 15/09* (2006.01)

(52) U.S. Cl. ..... 399/272; 399/291; 399/293

(58) Field of Classification Search ..... 399/107, 399/111, 119, 120, 252, 258, 259, 265, 266, 399/272, 290, 291, 292, 293, 294, 295
See application file for complete search history.

(56) References Cited

U.S. PATENT DOCUMENTS

| | | | | |
|---|---|---|---|---|
| 4,994,859 | A * | 2/1991 | Mizuno et al. | 399/266 |
| 5,142,336 | A * | 8/1992 | Hotomi et al. | 399/281 |
| 5,619,765 | A | 4/1997 | Konishi et al. | |
| 5,638,842 | A | 6/1997 | Konishi et al. | |
| 6,505,014 | B2 | 1/2003 | Aoki et al. | |
| 6,658,227 | B2 | 12/2003 | Oyama et al. | |
| 6,665,510 | B1 * | 12/2003 | Hirsch | 399/265 |
| 6,671,484 | B2 | 12/2003 | Miyoshi et al. | |
| 6,721,516 | B2 | 4/2004 | Aoki et al. | |
| 6,782,225 | B2 | 8/2004 | Kai et al. | |
| 6,901,233 | B2 | 5/2005 | Aoki et al. | |
| 7,035,575 | B2 | 4/2006 | Ikeguchi et al. | |
| 7,181,155 | B2 | 2/2007 | Aoki et al. | |
| 7,209,685 | B2 | 4/2007 | Oyama et al. | |
| 2006/0198663 | A1 | 9/2006 | Miyoshi et al. | |
| 2006/0228135 | A1 | 10/2006 | Miyoshi et al. | |

FOREIGN PATENT DOCUMENTS

| | | |
|---|---|---|
| JP | 05-346736 | 12/1993 |
| JP | 2000-010386 | 1/2000 |

* cited by examiner

*Primary Examiner*—Hoan H Tran
(74) *Attorney, Agent, or Firm*—Oblon, Spivak, McClelland, Maier & Neustadt, P.C.

(57) ABSTRACT

A development device configured to develop an electrostatic latent image on an image carrying member with a two-component developer having a toner and a carrier, the development device including: a developer carrying member to carry the two-component developer to a development region in which the developer carrying member faces the image carrying member; a developer control member to control a volume of the two-component developer; a plurality of electrodes to be separately disposed in a direction parallel to a rotation axis of the developer carrying member while separated from a surface of the developer carrying member and located between the developer control member and the development region in a rotation direction of the developer carrying member; and a power source to apply a power to the plurality of electrodes to form a periodically changing electric field generating an external force to convey the two-component developer in the rotation axis direction.

6 Claims, 4 Drawing Sheets

DEVELOPMENT DEVICE AND PROCESS CARTRIDGE INCLUDING DEVELOPMENT DEVICE

CROSS-REFERENCE TO RELATED APPLICATION

This application claims the benefit of priority under 35 U.S.C. §119 from the prior Japanese Patent Application No. 2006-225724, filed on Aug. 22, 2006, the entire contents of which is incorporated herein by reference.

BACKGROUND

1. Field of Invention

Exemplary aspects of the present invention relate to a development device and a process cartridge for use in an image forming apparatus. More particularly, the present invention relates to a development device and a process cartridge which form a toner image on a photoconductor by transferring a toner of a two-component developer on a development roller with an electric field.

2. Description of the Related Art

A two-component development device for use in an image forming apparatus includes a developer container containing a two-component developer including a toner and a carrier therein. The developer container includes a developer agitation conveyance member configured to agitate the two-component developer to obtain a uniform toner density and to convey the agitated two-component developer towards a developer carrying member having a magnetic pole therein. The surface of the developer carrying member carries the two-component developer thereon to an electrostatic latent image on an image carrying member, thereby developing the electrostatic latent image with the two-component developer to form a toner image.

Such a developing device typically includes an agitation unit collecting and agitating the two-component developer, which has been used for a development process at least once, so as to be mixed with an additional toner supplied. When the developer and the additionally supplied toner are not adequately mixed or agitated, an abnormal image such as an uneven image density can be formed. The degree of the agitation can be determined based on the toner consumption (i.e., the ratio of the toner consumed to the two-component developer). For example, in a high speed and small-sized two-component development device, the amount of toner consumption is large relative to the volume of the two-component developer. Therefore, the agitation unit needs to enhance the agitatability thereof.

A variety of methods of enhancing the agitatability of a developer agitation conveyance member have been proposed.

One example attempts to enhance functions of mixing and agitating a two-component developer having a toner and a carrier. In a development device using a two-component developer to develop an electrostatic latent image, a mixture state of the toner and the carrier therein can influence the image qualities. Therefore, this example offers proposals for enhancing the mixing and agitating functions.

In addition, a development device in which an electric field is formed on or at a location between a developer layer control member and a development region is proposed to enhance the chargeability of the toner or to allow toner particles to jump to obtain a high quality image.

Further, proposals such that the rotation speed of an agitation screw is increased and an agitation screw with an improved shape is used have been made to enhance the agitatability of an agitation unit.

Another example attempts to form an alternating electric field in an upstream side from a development region in a development device of an image forming apparatus to impart an appropriate charging quantity of the toner while reducing a mechanical stress.

However, such development devices require driving motors with large torque. In addition, the development devices apply a large amount of energy to the developer, resulting in acceleration of developer deterioration. Also, when the agitation unit performing high speed agitation is used, the shaft of an agitation member, etc. can be worn, resulting in deterioration of the durability of the development device.

SUMMARY

According to an aspect of the invention, a development device develops an electrostatic latent image on an image carrying member with a two-component developer having a toner and a carrier, and includes a developer carrying member, a developer control member, a plurality of electrodes, and a power source. The developer carrying member carries the two-component developer to a development region in which the developer carrying member faces the image carrying member. The developer control member controls a volume of the two-component developer carried by the developer carrying member. The plurality of electrodes are separately disposed one from another in a direction parallel to a rotation axis of the developer carrying member while separated from a surface of the developer carrying member and located between the developer control member and the development region in a rotation direction of the developer carrying member. The power source applies a power to the plurality of electrodes to form a periodically changing electric field changing an external force therebetween to convey the two-component developer in the rotation axis direction.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
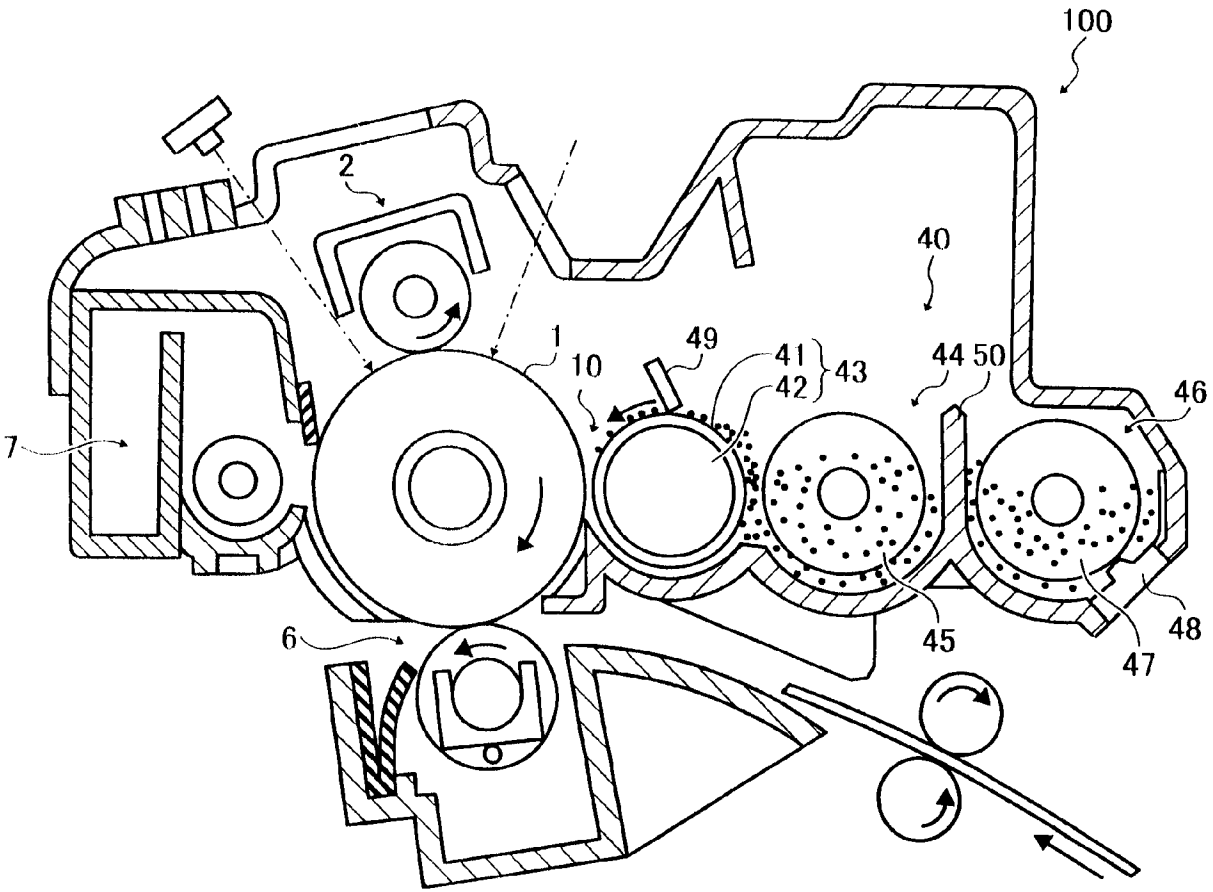
FIG. 1 is a partial cross sectional diagram partially illustrating an image forming apparatus including a development device according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or a feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, a development device according to an exemplary embodiment of the present invention is described.

Referring to FIG. 1, an image forming apparatus 100 including a development device 40, a photoconductor drum 1, a charging device 2, a transfer device 6 and a cleaning device 7 is partially illustrated. The development device 40 includes a development roller 43, a first developer container 44, a second developer container 46, a toner density sensor 48, a doctor blade 49 and a partition wall 50. The first developer container 44 includes a first conveyance screw 45. The second developer container 46 includes a second conveyance screw 47. The development roller 43 includes a development sleeve 41 and a magnet roller 42.

The development device 40 develops an electrostatic latent image on the photoconductor drum 1 with a two-component developer including a toner (also referred to as a toner particle) and a carrier (also referred to as a carrier particle) to form a toner image. The separation wall 50 separates the first developer container 44 and the second developer container 46 each of which contains the two-component developer having the toner with a negative charging property and a magnetic carrier. The first conveyance screw 45 is rotationally driven by a driving mechanism (not shown) so that the two-component developer in the first developer container 44 is conveyed from a front side to a rear side of FIG. 1. The development roller 43 as a developer carrying member is disposed in a left side of the first developer container 44 as shown in FIG. 1, and carries the two-component developer. The first development roller 43 and the first conveyance screw 45 are disposed in a parallel in such a manner as to be opposite each other through a space therebetween. The development sleeve 41 of the development roller 43 includes a pipe form sleeve of a non-magnetic material, and is rotationally driven by a driving mechanism (not shown) in a counterclockwise direction. The magnetic roller 42 of the development roller 43 is disposed inside the development sleeve 41 and is fixed so as not to be rotated with the development sleeve 41. The first conveyance screw 45 as an agitation mechanism agitates and conveys the two-component developer within the first developer container 44, and the magnetic roller 42 magnetically attracts the two-component developer to a surface of the development sleeve 41. The toner density sensor 48 detects a toner density. The doctor blade 49 is disposed opposite to the surface of development sleeve 41 through a suitable space therebetween, and controls a thickness of the two-component developer as a developer control member.

The first developer container 44 supplies the two-component developer in response to the rotation of the development sleeve 41. The doctor blade 49 wipes excess developer to control the thickness of the two-component developer. The development roller 43 conveys the two-component developer to a development region 10 in which the development sleeve 41 thereof is opposite to the photoconductor drum 1 so that the toner is adhered to the electrostatic latent image on the photoconductor drum 1. Consequently, the electrostatic latent image is developed by using the toner. According to the such a manner, the toner is consumed, and a residual two-component developer on the development sleeve 41 is conveyed back to the first developer container 44 with the rotation of the development sleeve 41.

The first conveyance screw 45 conveys the residual two-component developer to an end vicinity of the rear side of FIG. 1 with the rotation thereof. Since the partition wall 50 is not disposed in the end vicinity of the rear side between the first developer container 44 and the second developer container 46, the residual two-component developer is conveyed from the first developer container 44 to the second developer container 46. The second conveyance screw 47 as another agitation mechanism in the second developer container 46 is rotationally driven by a driving mechanism (not shown) so that the residual two-component developer is agitated and conveyed from the rear side to the front side. In the course of agitating and conveying the residual two-component developer, a toner supply mechanism (not shown) properly supplies additional toner to increase the toner density to a suitable level. The second conveyance screw 47 conveys the two-component developer with the suitable toner density to an end vicinity of the front side in which the partition wall is not disposed so that the two-component developer is conveyed back to the first developer container 44 from the second conveyance screw 47. Therefore, the two-component developer is conveyed within the development device 40 in a following circulation order: the first developer container 44, the development roller 43, the first developer container 44, the second developer container 46, and the first developer container 44.

The toner supply mechanism is connected to the second developer container 46 to which the additional toner is properly supplied. The second developer container 46 includes the toner density sensor 48 in a bottom thereof. The toner density sensor 48 includes a magnetic permeability sensor. For example, the toner density sensor 48 outputs a voltage value corresponding to a magnetic permeability of the two-component developer conveyed by the second conveyance screw 47. The permeability of the two-component developer correlates with the toner density. In other words, the toner density sensor 48 outputs the voltage value corresponding to the toner density. The output voltage value from the toner density sensor 48 is transmitted to a control unit (not shown). A random access memory (RAM) of the control unit stores a target voltage value Vtref which is a target value for the voltage output from the toner density sensor 48. The control unit controls a driving of the toner supply mechanism to properly supply the additional toner into the second developer container 46 such that the output voltage value from the toner density sensor 48 becomes (or becomes close to) the target voltage value Vtref. Thereby, the toner density of the two-component developer in the development device 40 can be maintained within a suitable range.

According to the exemplary embodiment, the development device 40 is used for the image forming apparatus 100 which includes, for example, the photoconductor drum 1 as an image carrier, the charging device 2, a writing device (not shown), the development device 40, a transfer device 6, and the cleaning device 7. As shown in FIG. 1, the charging device 2, the writing device, the development device 40, the transfer device 6, and the cleaning device 7 are disposed in the vicinity the photoconductor drum 1. The charging device 2 charges the photoconductor drum 1 while rotating thereof in a direction indicated by an arrow shown in FIG. 1. The transfer device 6 transfers the toner image onto a transfer sheet, for example. The cleaning device 7 removes a remaining toner from the surface of the photoconductor drum 1. The photoconductor drum 1 and at least one of the charging device 2, the development device 40 and the cleaning device 7 form a process cartridge as a unit which will be described below.

The process cartridge integrally supports the photoconductor drum 1 and at least one of the devices selected from the charging device 2, the development device 40 and the cleaning device 7, and is detachably attached to the image forming apparatus 100. According to the exemplary embodiment, the process cartridge includes the development device 40.

The descriptions of the development device 40 and the process cartridge will be given below. Having generally described the exemplary embodiment of the present invention, further understanding can be obtained by reference to certain specific examples which are provided herein for the purpose of illustration only and are not intended to be limiting.

According to the exemplary embodiment, the development sleeve 41 of FIG. 1 is the pipe form sleeve with a diameter of 18 mm. A surface of the development sleeve 41 is sandblasted so as to be ranged between 10 and 20 μm in a ten point mean roughness RZ, thereby, enhancing a conveyance property of the two-component developer. The surface of the development sleeve 41 can include a plurality of grooves each of which has a depth of 1 to several mm to enhance the conveyance property.

Figure 2:
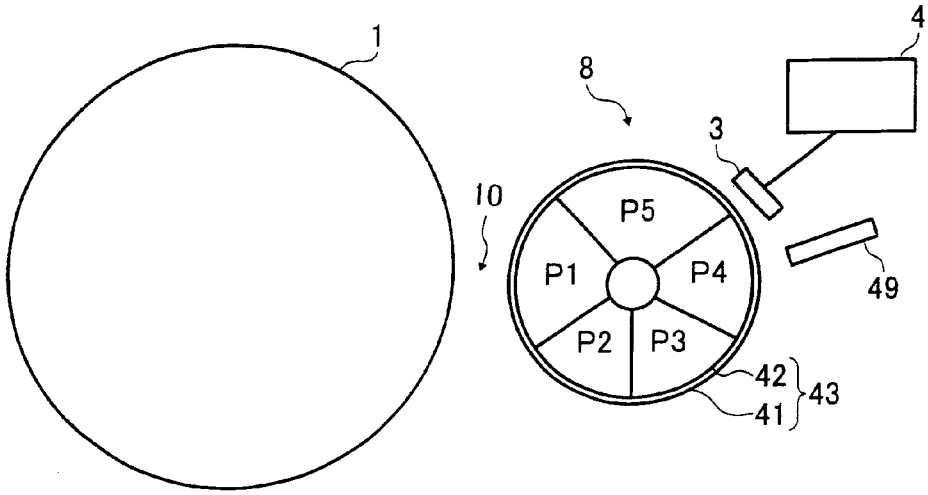
FIG. 2 is a schematic diagram illustrating a development roller, an electrode member, and a photoconductor drum of the image forming apparatus of FIG. 1.

Referring to FIG. 2, the magnetic roller 42 disposed inside the development sleeve 41 includes a first magnetic pole P1, a second magnetic pole P2, a third magnetic pole P3, a fourth magnetic pole P4, and a fifth magnetic pole P5 arranged in a circumference direction. The first magnetic pole P1, the second magnetic pole P2, the third magnetic pole P3, the fourth magnetic pole P4, the a fifth magnetic pole P5 respectively include the south pole, the north pole, the south pole, the south pole and the north pole. The first magnetic pole P1 is disposed in a backside of the development sleeve 41 in the development region 10. The first magnetic pole P1 acts as a development pole, and has the strongest magnetic force among the five magnetic poles. For example, the first magnetic pole P1 has a magnetic flux density of 100 mT so that the two-component developer on the development sleeve 41 stands in a chain shape to form a magnetic brush (not shown) in the development region. For example, the magnetic brush has a plurality of chains. Each of the chains acts as a fiber of a brush and includes a plurality of carrier particles and a plurality of toner particles attached thereto.

The photoconductor drum 1 includes a pipe, for example, a metal pipe, having an organic photoconductor applied thereto to form a photosensitive layer thereon. As the first magnetic pole P1 forms the magnetic brush with the magnetic force thereof, the magnetic brush passes a development gap in the development region while contacting the photoconductor drum 1 with a leading end thereof. The development gap is approximately 0.44 mm. Here, the photoconductor drum 1 has a non-image forming area potential VD of −350V, a latent image area potential VL of −50V, and a development sleeve potential VB of −250V. The development sleeve potential VB represents a potential of a development bias applied to the development sleeve 41. When a leading end of the magnetic brush contacts the latent image area on the photoconductor drum 1 in the development region, the toner on the leading end has a development potential of 200V (VL−VB=200) applied thereto. Therefore, the toner is electrostatically transferred from a surface of the magnetic carrier of the magnetic brush to the latent image on the photoconductor drum 1 to form the toner image. By contrast, when the leading end of the magnetic brush contacts the non-image forming area of the photoconductor drum 1, the toner on the leading end has a non-development potential of −100V (VD−VB=−100) applied thereto. Therefore, the likelihood of adhesion of the toner to the non-image forming area can be reduced. The magnetic pole P1 has an angle of zero degrees with respect to the photoconductor drum 1, and a half-width thereof is 42 degree. The magnetic pole P2 has the magnetic flux density of 90 mT, and the half-width thereof is 42 degrees. The photoconductor drum 1, for example, rotates clockwise at a linear speed of approximately 150 mm/sec. The development sleeve 41, for example, rotates counterclockwise at the linear speed of approximately 250 mm/sec.

According to the exemplary embodiment, the doctor blade 49 and the development sleeve 41 have the space therebetween, and the shortest distance thereof is 0.6 mm. The doctor blade 49 is also disposed opposite to a magnet 8. A magnetic pole of the magnet 8 is positioned at an angle towards an upstream side in the rotation direction of the development sleeve 41 relative to the doctor blade 49. Therefore, the two-component developer conveyed back from the doctor blade 49 can easily form a circulating flow.

An electrode member 3 is disposed in a vicinity of the doctor blade 49 as shown in FIG. 2, and a description thereof will be given below with reference to FIG. 3. The electrode member 3 is connected to a power source 4. For example, the power source 4 can include a two-phase alternating current power supply 14, a pulse power supply 15, and a three-phase-alternating current power supply 16, which will be described later.

Figure 3:
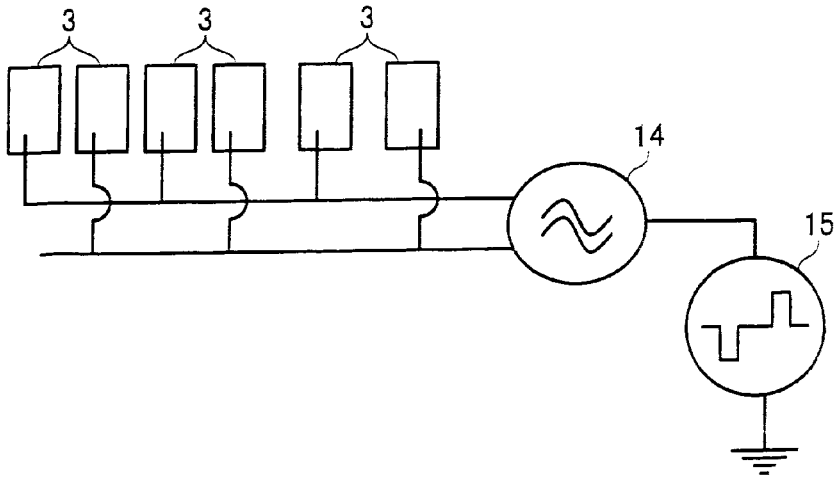
FIG. 3 is a schematic diagram illustrating the electrode member of FIG. 2.

Referring to FIG. 3, the electrode member 3 includes the two-phase (also referred to as single-phase) alternating current power supply 14 and a pulse power supply 15 in the vicinity thereof. The two-phase alternating current power supply 14 supplies a two-phase alternating current to the electrode member 3. The pulse power supply 15 applies a pulse wave having a different polarity from the alternating current.

Figure 4A:
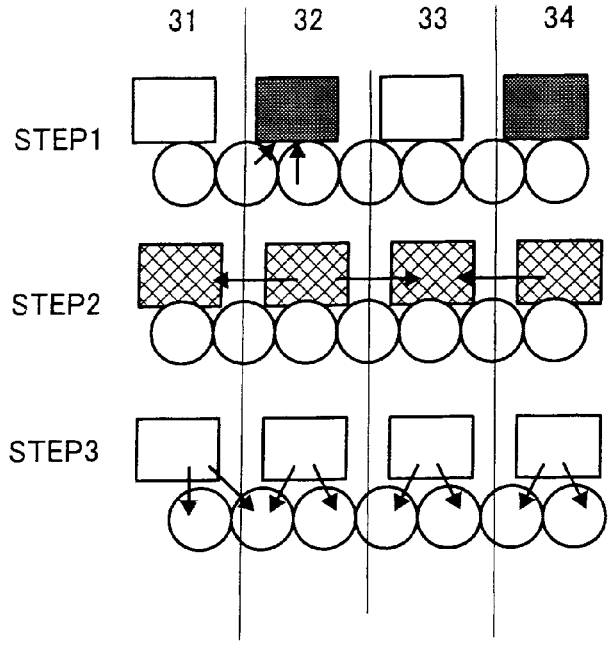
FIG. 4A is a schematic diagram illustrating a toner movement among a plurality of electrodes and carriers.

Referring to FIG. 4A, movements of the toner (i.e., the toner particles) among the electrode member 3 and the carrier particles are illustrated. The electrode member 3 includes a plurality of electrodes such as a first electrode 31, a second electrode 32, a third electrode 33, and a fourth electrode 34. In FIG. 4A, the arrows indicate the movements of the toner particles, and the circles indicate the carrier particles.

The electrode member 3 agitates the toner by attaching, distributing and detaching processes. The toner is attached to at least one of the electrodes 31, 32, 33 and 34 (Process 1). The toner on the at least one of the electrodes is distributed to other electrodes (Process 2). The toner is detached from the electrodes and contacts the carrier (Process 3). Therefore, the attaching, distributing, and detaching processes (Processes 1, 2 and 3) are repeated while changing the phase of the two-phase alternating current. Consequently, the toner can not only reduce an imbalance thereof but also can enhance the agitation thereof. According to the exemplary embodiment, the development sleeve 41 has a potential of −500V, the two-phase alternating current power supply 14 has a voltage (Vpp) of 400V, and the pulse power supply 15 has the pulse wave having an amplitude of 250V.

The two-phase alternating current power source 14 has a cycle of 1 KHz. The toner is conveyed in an amount of one carrier (or an approximate amount of one carrier) during the one cycle.

For example, when an electric field with a phase difference n is applied to an odd-numbered electrode (e.g., the first electrode 31) and an even-numbered electrode (e.g., the second electrode 32), the toner particles are attached to the even-numbered electrode (Process 1). Subsequently, the attached toner particles are distributed to neighboring electrodes (Process 2). The distributed toner particles contact the carrier particles (Process 3). Through repeatedly conducting the attaching, distributing and detaching processes (Processes 1, 2 and 3), the toner can not only obtain a suitable charging quantity but also be conveyed. The first, second, third, and fourth electrodes 31, 32, 33 and 34 can change potential thereof in the course of the attaching, distributing and detaching processes. A description of the potential changes will be given with reference to FIG. 4B.

Figure 4B:
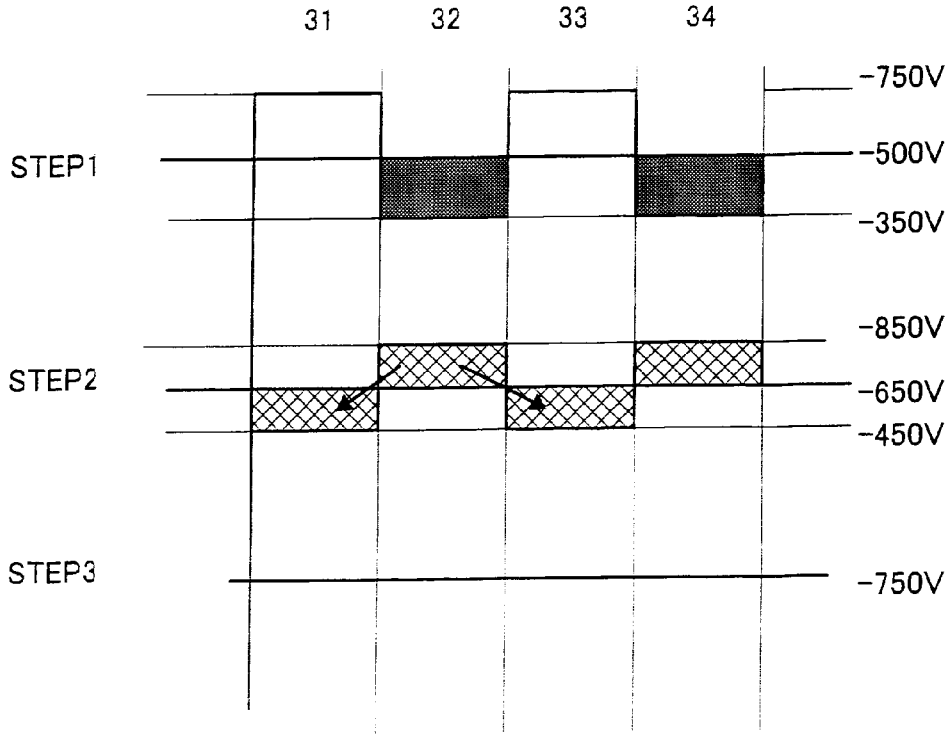
FIG. 4B is a schematic diagram illustrating a potential change of each of the plurality of electrodes of FIG. 4A.

FIG. 4B shows the potential change of each of the first, second, third, and fourth electrodes 31, 32, 33 and 34 in each of the attaching, distributing, and detaching processes.

Each of the first, second, third and fourth electrodes 31, 32, 33 and 34 and the magnetic brush have a space therebetween. When each of the electrodes 31, 32, 33 and 34 applies the electric field while the magnetic brush maintains in the chain shape, each of the chains becomes high and rough states, thereby forming a space within the magnetic brush. Therefore, the toner can be easily transferred. The development sleeve 41 needs a normal magnetic flux density that is at least greater than a tangent magnetic flux density so that the magnetic brush stands in the chain shape.

According to the exemplary embodiment, the electrode member 3 is disposed to apply an appropriate voltage. Therefore, the image can be formed without having a density unevenness even using the two-component developer having a volume of 150 g.

Figure 5:
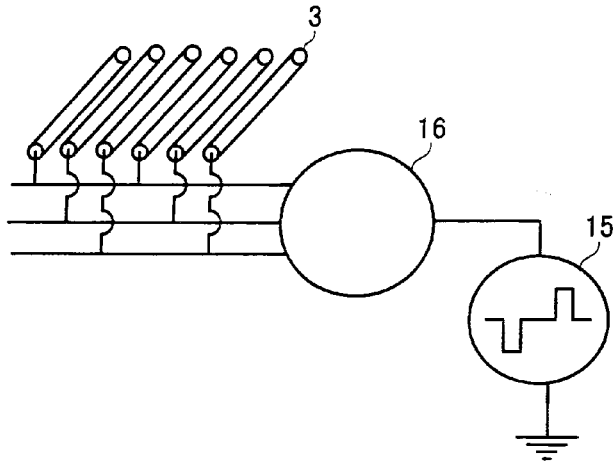
FIG. 5 is a schematic diagram illustrating a three-phase alternating current power supply forming an electric field applied to the development device according to another exemplary embodiment of the present invention.

Referring to FIG. 5, the electrode member 3 is illustrated according to another exemplary embodiment of the present invention. As the electrode member 3 of FIG. 5 is similar to that of FIG. 3, except for a three-phase alternating current power supply 16 in the vicinity thereof, like reference numbers used in FIG. 5 and FIG. 3 designate corresponding parts and description thereof will be omitted.

The three-phase alternating current power supply 16 is used to generate the electric field. In the three-phase alternating current power supply 16, each phase of the two-phase alternating current power supply 14 of FIG. 3 is shifted by 120 degrees, thereby having three phases to apply the potential. In this way, a conveyance direction of the toner can be controlled, and the toner can enhance the agitation thereof. According to the exemplary embodiment, three electrodes form a group, and a number of the electrodes is expressed by 3 n, where n is an integer of 1 or greater. For example, the first electrode 31, the second electrode 32, and the third electrode 33 have the phase differences of apply voltages of 120 degree ($2\pi/3$). In other words, the toner particles are attached with respect to every three electrodes in the process 1 of FIG. 4A. During the subsequent process, the toner particles are distributed to a double number (or approximately a double number) of electrodes compared to the above-described exemplary embodiment. The toner particles contact the carrier particles as similar to the above-described exemplary embodiment in the process 3.

Figure 6:
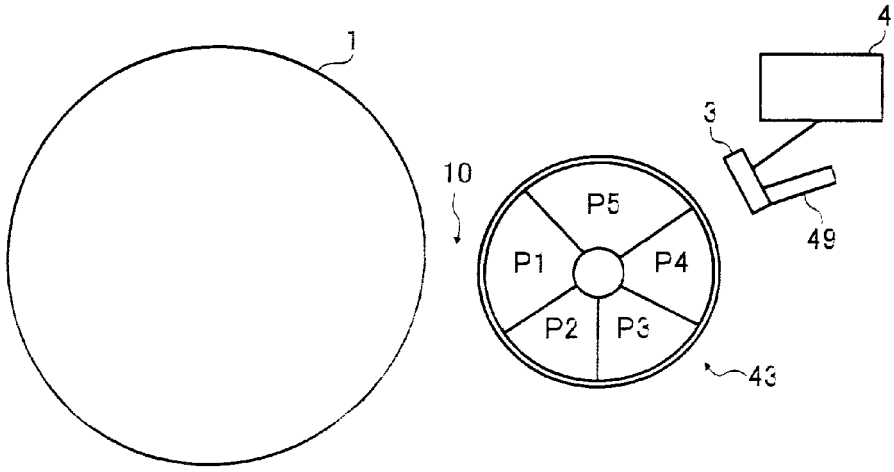
FIG. 6 is a schematic diagram illustrating a combination of the electrode member and a doctor blade provided in the development device according to still another exemplary embodiment of the present invention.

According to still another exemplary embodiment of the present invention, the electrode member 3 is disposed with the doctor blade 41 as shown in FIG. 6. The illustration of FIG. 6 is similar to that of FIG. 2, except for a location of the doctor blade 41, like reference numbers used in FIG. 6 and FIG. 2 designate corresponding parts and description thereof will be omitted.

As shown in FIG. 6, the electrode member 3 is disposed together with the doctor blade 41 so that installation thereof can be simplified, and the development device 40 can have a reduced size.

According to yet another exemplary embodiment, the toner has preferably a circularity of at least 0.96. The circularity is measured by a flow-type particle image measurement device. When the toner has the circularity of below 0.96, a contact face can be changed by the toner, thereby generating a difference in non-electrostatic adhesion force. When the toner has the circularity of at least 0.96, the non-electrostatic adhesion force can be made uniform. Therefore, the toner can enhance applicability thereof with respect to the electric field, and the toner density can enhance uniformability thereof.

The preferable toner (referred to as a new toner) and an ordinary toner (referred to as a conventional toner) that is generally used were prepared as will be described below.

Having generally described the exemplary embodiment of the invention, further understanding can be obtained by reference to certain specific examples which are provided herein for the purpose of illustration only and are not intended to be limiting. In the descriptions in the following examples, the numbers represent weight ratios in parts, unless otherwise specified.

Preparation of Conventional Toner

The following components were mixed by HENSCHEL MIXER, and the mixture was kneaded using a compact two-roll mill at 150° C.

| | |
|---|---|
| Binder resin<br>(Styrene - methyl acrylate copolymer) | 100.0 parts |
| Carbon black colorant<br>(#44 from Mitsubishi Chemical Corporation) | 10.0 parts |
| Charge controlling agent<br>(Zinc salt of di-tert-butyl salicylic acid, BONTRON ® E-84 from Orient Chemical Industries Co., Ltd.) | 2.0 parts |
| Carnauba wax | 5.0 parts |

The kneaded mixture was coarsely pulverized using a pulverizer equipped with a screen having openings of 2 mm, followed by and pulverization by using a pulverizer LABO JET. The pulverized particles were classified by using a classifier 100 MZR. Thus, colored particles (1) having a particle diameter of from 4 to 10 μm were prepared.

In order to impart favorable fluidity, developability, transferability, cleanability, and chargeability to the colored particles (1), 95 parts of the colored particles (1) prepared above, and 3 parts of a silica and 2 parts of a titanium oxide (both having an average particle diameter of 20 nm) were mixed for 2 minutes by a HENSCHEL MIXER mixer, and the mixture was sieved. Consequently, a conventional toner was prepared.

The average circularity of the conventional toner was measured by a flow-type particle image analyzer FPIA-2000 (from Sysmex Corporation). The conventional toner had an average circularity of 0.93 and a weight average particle diameter of 5.73 μm.

Preparation of New Toner

The colored particles prepared above were subjected to a treatment using SURFUSING SYSTEM (from Nippon Pneumatic Mfg. Co., Ltd.) under the following conditions.

Thermal treatment temperature: 250° C.

Volume of hot air: 1000 liter/min.

Volume of supplying air: 100 liter/min.

This treatment was preformed twice. Thus, colored particles (2) having a particle diameter of from 4 to 10 μm were prepared.

In order to impart favorable fluidity, developability, transferability, cleanability, and chargeability to the colored particles (2), 95 parts of the colored particles (2) prepared above, and 3 parts of a silica and 2 parts of a titanium oxide (both having an average particle diameter of 20 nm) were mixed for 2 minutes by HENSCHEL MIXER, and then the mixture was sieved. Therefore, the new toner was prepared.

The new toner had an average circularity of 0.96 and a weight average particle diameter of 5.56 μm.

In the present example, a pulverized toner is thermally treated so as to increase the circularity. On the other hand, a pulverized toner can alter the shape into spherical form by continuously applying mechanical stress using machines such as TURBO MILL (from Turbo Kogyo Co., Ltd.) disclosed in JP-A 09-085741, KRYPTRON (from Kawasaki Heavy Industries, Ltd.), and Q-TYPE MIXER (from Mitsui Mining Co., Ltd.).

In addition, a highly spherical toner can be obtained by wet granulation methods such as a suspension polymerization method, a dispersion polymerization method, a dissolution suspension method.

According to another exemplary embodiment, an image is formed on a transfer sheet through a series of an image forming processes that are conducted by the image forming apparatus 100 having the development device 40 of above-described exemplary embodiment. The image forming processes are conducted by a plurality of image forming mechanisms. A description of the image forming mechanisms which have already been described with respect to FIG. 1 and the other figures is omitted, and like components will be given the same numerals as the above-described exemplary embodiment. A description of the image forming processes is given as follows.

The photoconductor drum 1 is rotationally driven at a suitable speed. The charging device 2 uniformly charges a surface of the photoconductor drum 1 with a suitable potential during the rotation of the photoconductor drum 1. Upon charging the photoconductor drum 1, an exposure device (not shown) irradiates the surface of the photoconductor drum 1 in a slit exposure manner and a laser beam scanning exposure manner, for example. Therefore, the surface of the photoconductor drum 1 forms the electrostatic latent image thereon. The development device 40 develops the electrostatic latent image with the two-component developer to form the toner image. A sheet feeding unit (not shown) feeds a transfer sheet between the photoconductor drum 1 and the transfer device 6 at a desired timing to the rotation of the photoconductor drum 1. The transfer device 6 transfers the toner image on the surface of the photoconductor drum 1 onto the transfer sheet. A fixing device (not shown) fixes the toner image on the transfer sheet. The image forming apparatus 100 ejects the transfer sheet with the toner image. The cleaning device 7 removes the remaining toner from the surface of the photoconductor drum 1. A discharger (not shown) discharges and initializes the photoconductor drum 1, and the charging device 2 uniformly charges the photoconductor drum 1 to form a next image.

Therefore, the development device 40 and the process cartridge of the exemplary embodiments are capable of carrying the two-component developer and include: the development roller 43, acting as the developer carrying member carrying the toner of the two-component developer to the development region; and the doctor blade 49, acting as the developer control member controlling the volume of the two-component developer. The developer carrying member is applied with the bias so that the electrostatic latent image on the photoconductor drum 1 acting as the image carrying member is developed. In addition, the development device 40 includes the plurality of electrodes such as the first, second, third, and fourth electrodes 31, 32, 33, and 34 in the vicinity thereof. Each of the plurality of electrodes is isolated one from another, and is disposed between the developer control member and the development region in the rotation direction of the developer carrying member. The plurality of electrodes are parallel to the rotation axis of the developer carrying member and is isolated from the surface of the developer carrying member with the space therebetween. Each of the electrodes and the developer carrying member has the electric field generated therebetween which cyclically varies in the rotation axis direction. The variation of the electric field causes generation of an external force capable of conveying the toner particles in the rotation axis direction. The electric field separates the toner from the carrier, thereby increasing a conveyance efficiency and a uniform efficiency (e.g., thinner layer) of the toner in the rotation axis direction, while reducing deterioration of the two-component developer without placing a mechanical stress. Therefore, the development device 40 and the process cartridge of the exemplary embodiments can enhance the speed thereof and reduce the size thereof.

Numerous additional modifications and variation are possible in light of the above teachings. It is therefore to be understood that within the scope of the appended claims, the disclosure of this patent specification may be practiced otherwise than as specifically described herein.

What is claimed is:

1. A development device configured to develop an electrostatic latent image on an image carrying member with a two-component developer including a toner and carrier, the development device comprising:

a developer carrying member configured to carry the two-component developer to a development region in which the developer carrying member faces the image carrying member;

a developer control member configured to control a volume of the two-component developer carried by the developer carrying member;

a plurality of electrodes separately disposed one from another in a direction parallel to a rotation axis of the developer carrying member while separated from a surface of the developer carrying member and located between the developer control member and the development region in a rotation direction of the developer carrying member; and a power source configured to apply a power to the plurality of electrodes to form a periodically changing electric field generating an external force to convey the two-component developer in the rotation axis direction.

2. The development device of claim 1, wherein the periodically changing electric field changes a phase thereof in the rotation axis direction.

3. The development device of claim 1, further comprising a magnetic field forming member configured to form a magnetic field in at least one portion of a space through which the plurality of electrodes face the two-component developer, wherein the magnetic field has a greater magnetic flux density in a normal direction of the developer carrying member than in a tangential direction thereof.

4. The development device of claim 1, wherein the plurality of electrodes are integrated with the developer control member.

5. The development device of claim 1, wherein the toner has an average circularity of at least 0.96.

6. A process cartridge comprising:

an image carrying member configured to carry an electrostatic latent image thereon; and the development device of claim 1 configured to develop the electrostatic latent image with the two-component developer, wherein the process cartridge is detachably attached to an image forming apparatus.

* * * * *